US011699547B2

(12) United States Patent
Yoshikawa et al.

(10) Patent No.: US 11,699,547 B2
(45) Date of Patent: Jul. 11, 2023

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kouhei Yoshikawa, Mie (JP); Kazushi Kusawake, Mie (JP); Shintaro Nanbara, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 1178 days.

(21) Appl. No.: 16/319,626

(22) PCT Filed: Jul. 7, 2017

(86) PCT No.: PCT/JP2017/024974
§ 371 (c)(1),
(2) Date: Jan. 22, 2019

(87) PCT Pub. No.: WO2018/020988
PCT Pub. Date: Feb. 1, 2018

(65) Prior Publication Data

US 2021/0327639 A1 Oct. 21, 2021

(30) Foreign Application Priority Data

Jul. 26, 2016 (JP) ..... 2016-146690

(51) Int. Cl.
*H01F 17/04* (2006.01)
*H01F 27/28* (2006.01)
(Continued)

(52) U.S. Cl.
CPC ..... *H01F 27/2823* (2013.01); *H01F 27/02* (2013.01); *H01F 27/24* (2013.01); *H01F 27/324* (2013.01)

(58) Field of Classification Search
CPC ..... H01F 27/2823
(Continued)

(56) References Cited

U.S. PATENT DOCUMENTS

2004/0085174 A1 5/2004 Decristofaro et al.
2005/0258926 A1* 11/2005 Weger ..... H01F 17/045 336/212
(Continued)

FOREIGN PATENT DOCUMENTS

JP 2011-142193 A 7/2011
JP 2012-099739 A 5/2012
(Continued)

OTHER PUBLICATIONS

English translation of JP2013179264 (Year: 2013).*
International Search Report, Application No. PCT/JP2017/024974, dated Oct. 17, 2017.

*Primary Examiner* — Ronald Hinson
(74) *Attorney, Agent, or Firm* — Honigman LLP

(57) ABSTRACT

A reactor includes a coil, an annular magnetic core that forms a closed magnetic circuit when the coil is excited, a plurality of divided reactors arranged in parallel, and a holding member that holds the plurality of divided reactors in a state in which the divided reactors are arranged in parallel at a predetermined spacing. Each of the divided reactors includes a coil unit that is formed of a wound wire and constitutes a part of the coil and a core unit that passes through the coil unit from one end of the coil unit to the other end and constitutes a part of the magnetic core. The core unit has an inner core portion inserted through the coil unit, and
(Continued)

outer core portions that protrude from both ends of the coil unit and extend in a direction that intersects the inner core portion.

5 Claims, 7 Drawing Sheets

(51) Int. Cl.
*H01F 27/02* (2006.01)
*H01F 27/24* (2006.01)
*H01F 27/32* (2006.01)

(58) Field of Classification Search
USPC ..... 336/221
See application file for complete search history.

(56) References Cited

U.S. PATENT DOCUMENTS

| | | | |
|---|---|---|---|
| 2006/0066433 | A1 | 3/2006 | Decristofaro et al. |
| 2014/0176291 | A1 | 6/2014 | Zheng et al. |

FOREIGN PATENT DOCUMENTS

| | | | |
|---|---|---|---|
| JP | 2013-179264 | A | 9/2013 |
| JP | 2014-067758 | A | 4/2014 |
| JP | 2014-067759 | A | 4/2014 |
| JP | 2014-078684 | A | 5/2014 |
| JP | 2014-160737 | A | 9/2014 |
| JP | 2016-134507 | A | 7/2016 |

* cited by examiner

3 : 30α , 30α
30α : 31α , 32α , 32α

1B : 10B, 10B
2 : 20, 20
3 : 30α, 30α
30α : 31α, 32α, 32α

1C : 10C, 10C
2 : 20, 20
3 : 30 α , 30 α
11 : 20, 30 α
30 α : 31 α , 32 α , 32 α

1D : 10D, 10D
2 : 20, 20
3 : 30 α , 30 α
11 : 20, 30 α
30 α : 31 α , 32 α , 32 α

REACTOR

CROSS-REFERENCE TO RELATED APPLICATIONS

This application is the U.S. national stage of PCT/JP2017/024974 filed Jul. 7, 2017, which claims priority of Japanese Patent Application No. JP 2016-146690 filed Jul. 26, 2016.

TECHNICAL FIELD

The present disclosure relates to a reactor.

BACKGROUND

One of the components of a circuit that increases and decreases the voltage is a reactor. For example, a reactor disclosed in JP 2014-146656A includes a coil having a pair of coil elements (coil units) and a magnetic core having a pair of U-shaped, divided core pieces (see 0045 of the specification and FIG. 3). Joint portions between the pair of divided core pieces are disposed inside the coil.

A reactor that is easy to adjust to a desired inductance has been in demand. When combining a coil and divided core pieces, it is difficult to accurately align the divided core pieces with each other because the alignment of the divided core pieces is performed inside the coil. For this reason, there is a risk that the divided core pieces will be shifted from appropriate positions relative to each other, and thus, a desired inductance may not be obtained. In particular, in a case where an air gap is provided between the divided core pieces, it is extremely difficult to align the divided core pieces at an appropriate spacing.

SUMMARY

To address this issue, an object of the present disclosure is to provide a reactor that enables easy adjustment of inductance. A reactor according to the present disclosure includes a coil, an annular magentic core, a plurality of divided reactors and a holding member. The annular magnetic core that forms a closed magnetic circuit when the coil is excited. The plurality of divided reactors that constitute the reactor are arranged in parallel. The holding member holds the plurality of divided reactors in a state in which the divided reactors are arranged in parallel at a predetermined spacing. Each of the divided reactors includes a coil unit and a core unit. The coil unit is formed of a wound wire and constitutes a part of the coil. The core unit that passes through the coil unit from one end of the coil unit to the other end and constitutes a part of the magnetic core. The core unit has an inner core portion inserted through the coil unit, and outer core portions that protrude from both ends of the coil unit and extend in a direction that intersects the inner core portion.

The reactor according to the present disclosure enables easy adjustment of inductance.

DETAILED DESCRIPTION OF PREFERRED EMBODIMENTS

Figure 1:
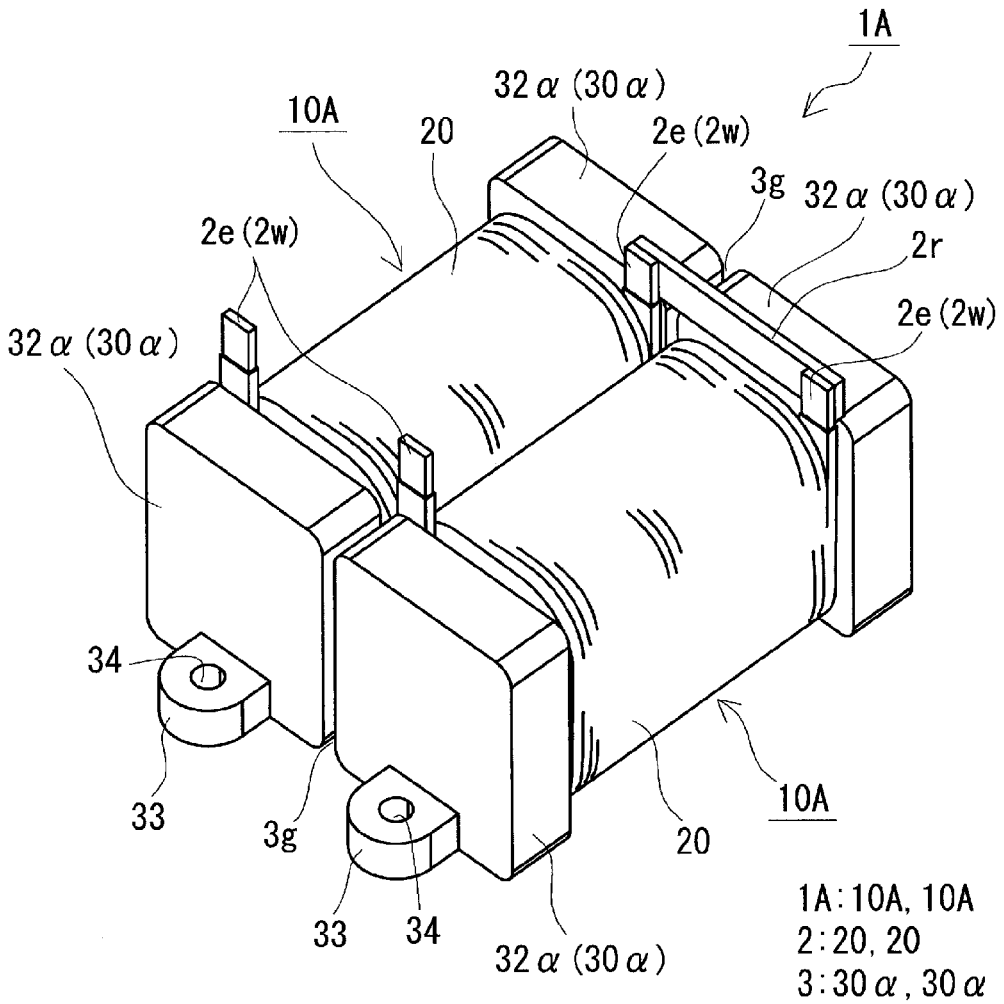
FIG. 1 is an overall perspective view schematically showing a reactor according to Embodiment 1.

First, aspects of the present disclosure will be listed and described.

A reactor according to the present disclosure includes a coil, an annular magentic core, a plurality of divided reactors and a holding member. The annular magnetic core that forms a closed magnetic circuit when the coil is excited. The plurality of divided reactors that constitute the reactor are arranged in parallel. The holding member holds the plurality of divided reactors in a state in which the divided reactors are arranged in parallel at a predetermined spacing. Each of the divided reactors includes a coil unit and a core unit. The coil unit is formed of a wound wire and constitutes a part of the coil. The core unit that passes through the coil unit from one end of the coil unit to the other end and constitutes a part of the magnetic core. The core unit has an inner core portion inserted through the coil unit, and outer core portions that protrude from both ends of the coil unit and extend in a direction that intersects the inner core portion.

With this configuration, the spacing of the plurality of divided reactors can be kept by the holding member simply by adjusting the spacing thereof, and therefore, the inductance can be easily adjusted.

As an embodiment of the above-described reactor, it is possible that the holding member includes attachment portions that are provided in each of the divided reactors and fix the core units to an object to which the reactor is attached such that the core units are arranged in parallel.

With this configuration, the attachment spacing of the plurality of divided reactors can be fixed simply by fixing the divided reactors to the object. Attachment seats (e.g., bolt holes) corresponding to the respective attachment portions can be provided in advance so that the divided reactors can be properly attached to predetermined positions of the object. Thus, an adjustment to a desired inductance can be easily made simply by adjusting the attachment positions. Moreover, since the inductance can be adjusted simply by adjusting the attachment positions, reactors with various magnetic properties can be easily obtained. Furthermore, in the case where gaps are formed using the attachment spacing of the divided reactors, the gaps can be adjusted simply by adjusting the positions of the attachment portions and without having to make any change to the configuration of the divided reactors.

As an embodiment of the above-described reactor in which the holding member includes the attachment portions, it is possible that each of the divided reactors has a case in which an assembly having the coil unit and the core unit is housed, and the case has the attachment portions.

With this configuration, protection from an external environment (dust, corrosion, etc.) and mechanical protection can be achieved.

As an embodiment of the above-described reactor, it is possible that the reactor further includes engagement portions in opposing surfaces of the outer core portions of adjacent ones of the divided reactors, the engagement portions engaging each other to thereby suppress displacement of the divided reactors relative to each other.

With this configuration, relative displacement of the divided reactors is likely to be suppressed, and therefore, a desired inductance is likely to be maintained. Details of the relative displacement will be described later.

As an embodiment of the above-described reactor, it is possible that the reactor further includes a gap that is provided between the outer core portions of adjacent ones of the divided reactors.

With this configuration, the size of the gaps can be adjusted by adjusting the attachment spacing between the divided reactors, and it is easy to adjust the inductance.

As an embodiment of the above-described reactor, it is possible that the outer core portions of adjacent ones of the divided reactors are in contact with each other, and no gap is provided therebetween.

With this configuration, since no gap is provided between the outer core portions, a reduction in the size of the reactor can be achieved.

Hereinafter, details of embodiments of the present disclosure will be described with reference to the drawings. In the drawings, like reference numerals denote objects having like names.

Embodiment 1

Reactor

A reactor 1A according to Embodiment 1 will be described with reference to FIGS. 1 and 2. The reactor 1A includes a coil 2 and an annular magnetic core 3 that forms a closed magnetic circuit when the coil 2 is excited. One of the features of this reactor 1A is that the reactor 1A includes a plurality of divided reactors 10A that constitute the reactor 1A by being arranged in parallel and a holding member that holds the plurality of divided reactors 10A in a state in which they are arranged in parallel, with a predetermined spacing between each other. Each of the divided reactors 10A has a coil unit 20 that constitutes a part of the coil 2 and a core unit 30α that constitutes a part of the magnetic core 3. Here, a form in which the reactor 1A includes two identical divided reactors 10A will be described as an example. First, the overall configuration of the reactor 1A will be described, followed by descriptions of the details of various components of the reactor 1A. Hereinafter, for the sake of convenience of the description, the side of an object to which the reactor is attached (fixed side) will be referred to as a lower side, and the side opposite thereto (opposing side) will be referred to as an upper side. An example of the object is a cooling base.

Overall Configuration

The reactor 1A includes a pair of divided reactors 10A and a holding member (attachment portions 33 here). The divided reactors 10A each include one of the two coil units 20 that are adjacent to each other and one of the two core units 30α that are adjacent to each other. That is to say, the coil 2 has two coil units 20, and the magnetic core 3 has two core units 30α. The two coil units 20 are electrically connected to each other via a connecting member 2*r*. A gap 3*g* may or may not be formed between the two core units 30α. Although a gap (air gap) 3*g* is provided between the core units 30α in this example, if a gap 3*g* is not provided, opposing surfaces of outer core portions 32α, which will be described later, of the core units 30α come into direct contact with each other. The gap 3*g* will be described later.

Configurations of Main Characteristic Portions and Related Portions Divided Reactors As described above, each of the divided reactors 10A has one coil unit 20 and one core unit 30α.

Coil Unit

A coil unit 20 is formed of a wound wire 2*w* and constitutes a part of the coil 2. The coil unit 20 is a hollow tubular body that is formed by winding the wire 2*w* into a helical shape. The wire 2*w* is a coated rectangular wire (so-called enameled wire) including a conductor (copper or the like) formed of a rectangular wire and an insulating coating (polyamideimide or the like) that covers an outer periphery of the conductor. The coil unit 20 is an edgewise coil that is formed by winding this coated rectangular wire edgewise. End surfaces of the coil unit 20 are each rectangular frame-shaped with rounded corners.

Both end portions 2*e* of the wire 2*w* of the coil unit 20 are extended upward at both ends in the axial direction of the coil unit 20. The insulating coating of a leading end of the end portion 2*e* on one end side (left side on the paper plane of FIG. 1) of the coil unit 20 in the axial direction is removed to expose the conductor, and a terminal member (not shown) is connected to the exposed conductor. An external device (not shown) such as a power supply that supplies power to the coil 2 is connected to the coil 2 via the terminal member. On the other hand, the insulating coating of a leading end of the end portion 2*e* on the other end side (right side on the paper plane of FIG. 1) of the coil unit 20 in the axial direction is removed to expose the conductor, and the connecting member 2*r* is connected to the exposed conductor. The connecting member 2*r* can be connected through welding or pressure welding. The connecting member 2*r* is formed of the same member as the wire 2*w*, for example.

A wire that has a thermally fusion-bonded layer made of a thermally fusion-bondable resin can be used as the wire 2*w*. In this case, after the wire 2*w* is appropriately wound, the wound wire 2*w* is heated at an appropriate timing to melt the thermally fusion-bonded layer, and adjacent turns of the wound wire 2*w* are joined to each other by the thermally fusion-bondable resin. In the thus obtained coil unit, since thermally fusion-bondable resin portions are present between the turns, the turns do not substantially offset from each other, and therefore the coil unit is unlikely to deform. Examples of the thermally fusion-bondable resin forming the thermally fusion-bonded layer include thermosetting resins such as epoxy resins, silicone resins, and unsaturated polyesters.

Core Units

A core unit 30α passes through a corresponding coil unit 20 from one end thereof to the other end, and constitutes a part of the magnetic core 3. The core unit 30α includes one inner core portion 31α and a pair of outer core portions 32α. Here, the inner core portion 31α and the pair of outer core portions 32α are integrally molded from a soft magnetic composite material, which is a constituent material of each core. The core unit 30α is integrally formed with the coil unit 20 using the constituent material of each core.

Inner Core Portion

The inner core portion 31α is inserted through the coil unit 20. It is preferable that the inner core portion 31α has a shape that matches the inner peripheral shape of the coil unit 20. Here, the shape of the inner core portion 31α is a rectangular parallelepiped shape with such a length that it extends over substantially the entire length of the coil unit 20 in the axial direction, and the corner portions of the rectangular parallelepiped shape are rounded so as to conform to the inner peripheral surface of the coil unit 20 whose corners are rounded.

Outer Core Portions

The outer core portions 32α protrude from both ends of the coil unit 20 and extend in a direction that intersects the inner core portion 31α. The outer core portions 32α may extend to such an extent that they are flush with side surfaces of the coil unit 20, or may protrude from the side surfaces. If a case 4 is provided as in Embodiment 2, which will be described later, the outer core portions 32α may be flush with the side surfaces of the coil unit 20. The outer core portions 32α each have a rectangular parallelepiped shape. The height and the width of each outer core portion 32α are larger than those of the inner core portion 31α, and may be equal to, or may be larger than, the height and the width of the coil unit 20. The height of each outer core portion 32α refers to the length thereof in a vertical direction, and the width of each outer core portion 32α refers to the length thereof in a direction in which the divided reactors 10A are arranged in parallel. Preferably, lower surfaces of the outer core portions 32α are flush with a lower surface of the coil unit 20.

Constituent Material

The soft magnetic composite material composing the core portions 31α and 32α contains a soft magnetic powder and a resin. Particles constituting the soft magnetic powder may be metal particles made of an iron-group metal, such as pure iron, or a soft magnetic metal, such as an iron-based alloy (Fe—Si alloy, Fe—Ni alloy, etc.); coated particles in which an insulating coating composed of a phosphate or the like is provided on outer peripheries of metal particles; particles made of a nonmetal material such as ferrite; or the like.

The amount of the soft magnetic powder contained in the soft magnetic composite material may be between 30 vol % and 80 vol % inclusive. The higher the soft magnetic powder content, the more the saturation flux density and the heat dissipation properties can be expected to be improved, and the lower limit can be set to be 50 vol % or more, and furthermore, 55 vol % or more, or 60 vol % or more. If the soft magnetic powder content is low to a certain extent, when the raw material (raw material mixture) of the soft magnetic composite material is filled into a mold, the raw material has excellent fluidity and is easy to fill into the mold, and the manufacturability can be expected to be improved. The upper limit can be set to be 75 vol % or less, and furthermore, 70 vol % or less.

The average particle diameter of the soft magnetic powder may be, for example, between 1 μm and 1,000 μm inclusive, and furthermore, between 10 μm and 500 μm inclusive. The average particle diameter can be obtained by acquiring a cross-sectional image under an SEM (scanning electron microscope) and analyzing the image using a piece of commercially-available image analysis software. At that time, an equivalent circle diameter is used as the particle diameter of a soft magnetic particle. To obtain the equivalent circle diameter, an outline of a particle is identified, and the diameter of a circle that has the same area as the area S of a region enclosed by the outline is determined as the equivalent circle diameter. That is to say, the equivalent circle diameter is expressed as follows: equivalent circle diameter$=2\times\{$area S of the inside of the outline$/\Pi\}^{1/2}$.

Examples of the resin in the soft magnetic composite material include thermosetting resins such as epoxy resins, phenolic resins, silicone resins, and urethane resins; thermoplastic resins such as polyphenylene sulfide (PPS) resins, polyamide (PA) resins (e.g., nylon 6, nylon 66, nylon 9T, etc.), liquid crystal polymers (LCPs), polyimide resins, and fluororesins; normal-temperature curing resins; and low-temperature curing resins. In addition, a BMC (bulk molding compound) manufactured by mixing calcium carbonate and glass fibers in unsaturated polyester, millable silicone rubber, millable urethane rubber, and the like can be used.

The soft magnetic composite material can also contain a filler powder made of a non-magnetic material such as a ceramic, such as alumina or silica, in addition to the soft magnetic powder and the resin. In this case, the heat dissipation properties, for example, can be improved. The amount of the filler powder contained in the soft magnetic composite material may be between 0.2 mass % and 20 mass % inclusive, and furthermore, between 0.3 mass % and 15 mass % inclusive, or between 0.5 mass % and 10 mass % inclusive.

Holding Member

The holding member holds the plurality of divided reactors 10A in a state in which the divided reactors are arranged in parallel at a predetermined spacing. Examples of the holding member include attachment portions 33 (FIGS. 1 to 3: Embodiments 1 and 2), 43 (FIGS. 4 and 5: Embodiments 3 and 4), or 53 (FIGS. 6 and 7: Embodiment 6) provided in each divided reactor 10A, a resin collectively-covering portion (not shown: Embodiment 7) with which the outer core portions 32α of at least adjacent divided reactors 10A are collectively coated, a support portion (not shown: Embodiment 8) that presses down an upper surface of at least one divided reactor 10A (outer core portions 32α) toward the lower surface side, and the like. Here, the holding member is constituted by the attachment portions 33.

Attachment Portions

An attachment portion 33 fixes a core unit 30α to the object. Here, attachment portions 33 are provided locally protruding from the respective outer core portions 32α like flanges. The portions where the attachment portions 33 are formed can be appropriately selected depending on the positions of the portions where a divided reactor 10A is attached to the object. If the attachment portions 33 are in contact with the object, creep deformation caused by a fastening member (not shown), such as a bolt, for attaching the divided reactor 10A to the object is likely to be suppressed. The reason for this is that the attachment portions 33 are also cooled directly by the object such as a cooling base. In that case, the attachment portions 33 need not be provided with a collar that receives a fastening force applied by the fastening member. Here, portions where each attachment portion 33 is formed are set at the center of lower portions of outer end surfaces of both outer core portions 32α. The attachment portions 33 are integrally formed with the respective outer core portions 32α using the constituent material of the outer core portions 32α. An insertion hole 34 through which a fastening member can be inserted is formed in each of the attachment portions 33.

Production of Divided Reactors

A divided reactor 10A can be produced by filling the inside and the outside of a coil unit 20 placed in a mold that has a predetermined shape with the raw material of the soft magnetic composite material and molding a core unit 30α, which is an integrally molded product. At this time, as described above, if the coil unit 20 has a thermally fusion-bonded layer, gaps between the turns are filled up. Thus, when the inside of the coil unit 20 is filled with the raw material, the filled material can be prevented from leaking from between the turns. Here, an outer peripheral surface of the coil unit 20 is exposed from the core unit 30α; however, the outer peripheral surface of the coil unit 20 may be covered with the constituent material of the core unit 30*a*.

Gaps

Figure 2:
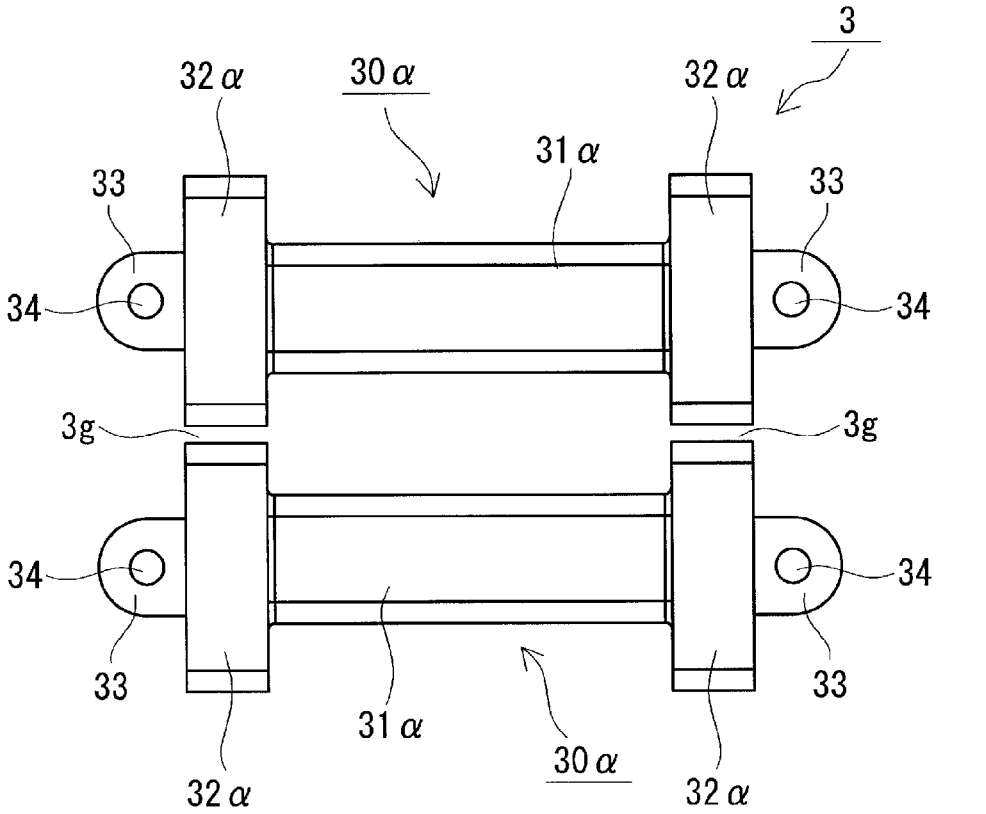
FIG. 2 is a top view showing a magnetic core included in the reactor according to Embodiment 1.

A gap 3*g* between the outer core portions 32α of the divided reactors 10A may be realized as an air gap as shown in FIG. 1 or, alternatively, can be realized by providing a gap member (not shown) composed of a material having lower relative permeability than the soft magnetic composite material. Examples of the constituent material of the gap member include a ceramic such as alumina, a non-magnetic material such as a resin (e.g., a PPS resin), a composite material containing a soft magnetic powder and a resin, an elastic material such as various types of rubber, and the like. The gap member may be inserted into and disposed in a space between the outer core portions 32α, or can be integrally molded during molding of an outer core portion 32α (core unit 30α).

Effects

With the reactor 1A according to Embodiment 1, an adjustment to a desired inductance can be easily made. This is because the adjustment can be made simply by adjusting the attachment positions of the divided reactors 10A. If an attachment seat (bolt hole) corresponding to each attachment portion 33 is provided in advance at a predetermined position in the object so that the divided reactors 10A can be properly attached, the attachment spacing between the plurality of divided reactors 10A can be fixed simply by fixing the attachment portions 33 of the divided reactors 10A to the object. Accordingly, even in the case where an air gap is provided, an adjustment to the desired inductance can be easily made. Moreover, since the inductance can be adjusted simply by adjusting the attachment positions, reactors 1A with various magnetic properties can be easily obtained.

Embodiment 2

Figure 3:
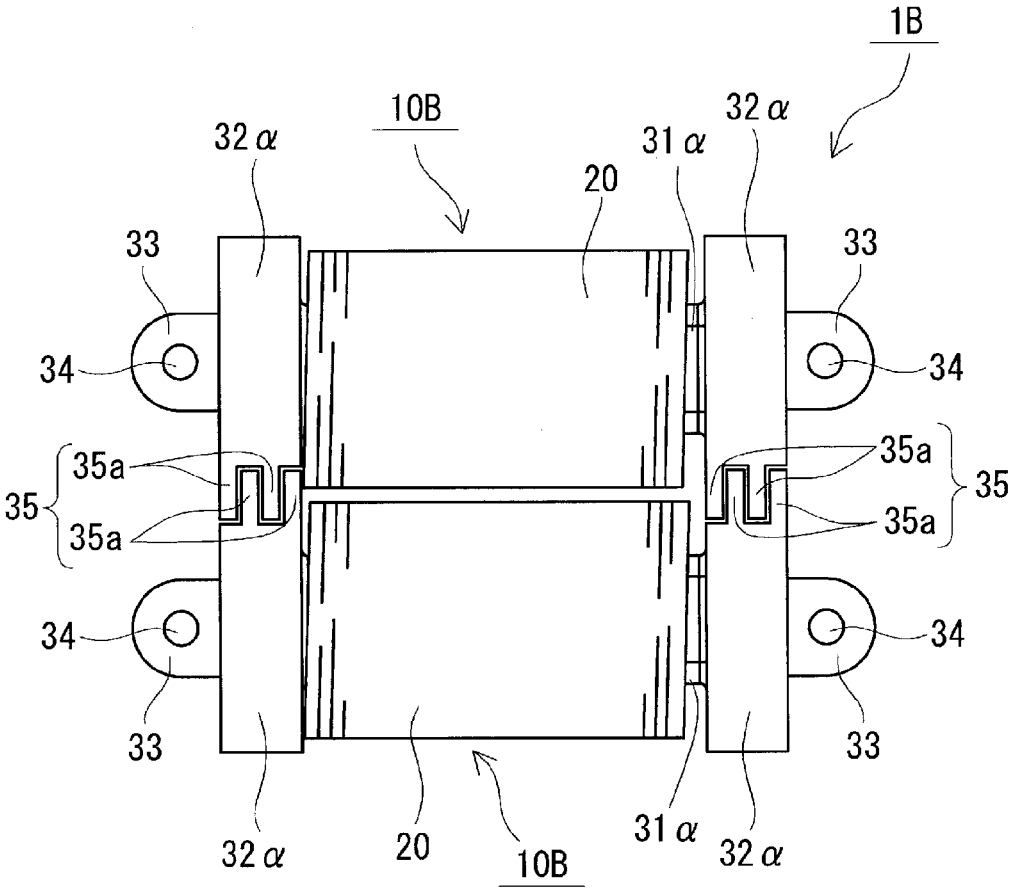
FIG. 3 is a top view schematically showing a reactor according to Embodiment 2.

A reactor 1B according to Embodiment 2 will be described with reference to FIG. 3. The reactor 1B differs from the reactor 1A according to Embodiment 1 in that the reactor 1B includes engagement portions 35 where the outer core portions 32α of divided reactors 10B engage with each other. Hereinafter, the difference will be mainly described, and descriptions of the same configurations and the same effects will be omitted. This also applies to Embodiments 3 to 6 below. In FIG. 3, for the sake of convenience of the description, the two end portions 2*e* of each coil unit 20 and the connecting member 2*r* (see FIG. 1) are not shown (the same applies to FIGS. 4 and 5, which will be described later).

Engagement Portions

The engagement portions 35 suppress displacement of the adjacent divided reactors 10B relative to each other. Examples of the relative displacement include displacement in the axial direction of the coil units 20, displacement in the vertical direction, displacement in the parallel arrangement direction, displacement in a rotating direction, and the like. The rotating direction as used herein refers to movement around an axis serving as the axis of rotation, the axis passing through the center of gravity of a divided reactor 10B and being orthogonal to the object (or an object-side surface of the divided reactor 10B). With the engagement portions 35 being included in the divided reactors 10B, during the attachment of the divided reactors 10B, mutual alignment can be easily performed, and mutual displacement is also likely to be suppressed thereafter. Thus, a desired inductance can be maintained. The engagement portions 35 are formed in opposing surfaces of the adjacent outer core portions 32α and integrally with the outer core portions 32α, using the constituent material of the outer core portions 32α.

It is sufficient that the engagement portions 35 have a recess and a projection that can be fitted to each other, and, for example, a plurality of comb-like teeth 35α may be provided. The number of comb-like teeth 35α and the direction in which the comb-like teeth 35*a* are lined up can be appropriately selected. The direction in which the comb-like teeth 35*a* are lined up may be set in a direction along the axial direction of the coil units 20 as in the present example, or may be set in a direction along the vertical direction of the coil units 20. The engagement portions 35 may also include comb-like teeth along the axial direction of the coil units 20 and comb-like teeth along the vertical direction of the coil units 20. For example, it is also possible that the direction in which the comb-like teeth 35*a* in an upper half of the opposing surfaces of the outer core portions 32α are lined up is set in the direction along the axial direction of the coil units 20, and the direction in which the comb-like teeth 35*a* in a lower half are lined up is set in the direction along the vertical direction of the coil units 20. Examples of the shape of the comb-like teeth 35*a* include a rectangular shape, an L-shape, and the like. The region in which the comb-like teeth 35*a* are formed may be a region extending over the entire length of the opposing surfaces of the outer core portions 32α in the vertical direction.

Here, the number of protrusions of the comb-like teeth 35*a* is two, and the direction in which the comb-like teeth 35*a* are lined up is set in the direction along the axial direction of the coil units 20. The shape of the comb-like teeth 35*a* is a rectangular shape having a uniform thickness from the base of the comb-like teeth 35*a* to the leading end side thereof. The region where comb-like teeth 35*a* are formed is a region extending over the entire length of the outer core portions 32α in the vertical direction.

Effects

With the reactor 1B according to Embodiment 2, since the engagement portions 35 are provided, relative displacement of the adjacent divided reactors 10B can be suppressed, and thus, a desired inductance is likely to be maintained.

Embodiment 3

Figure 4:
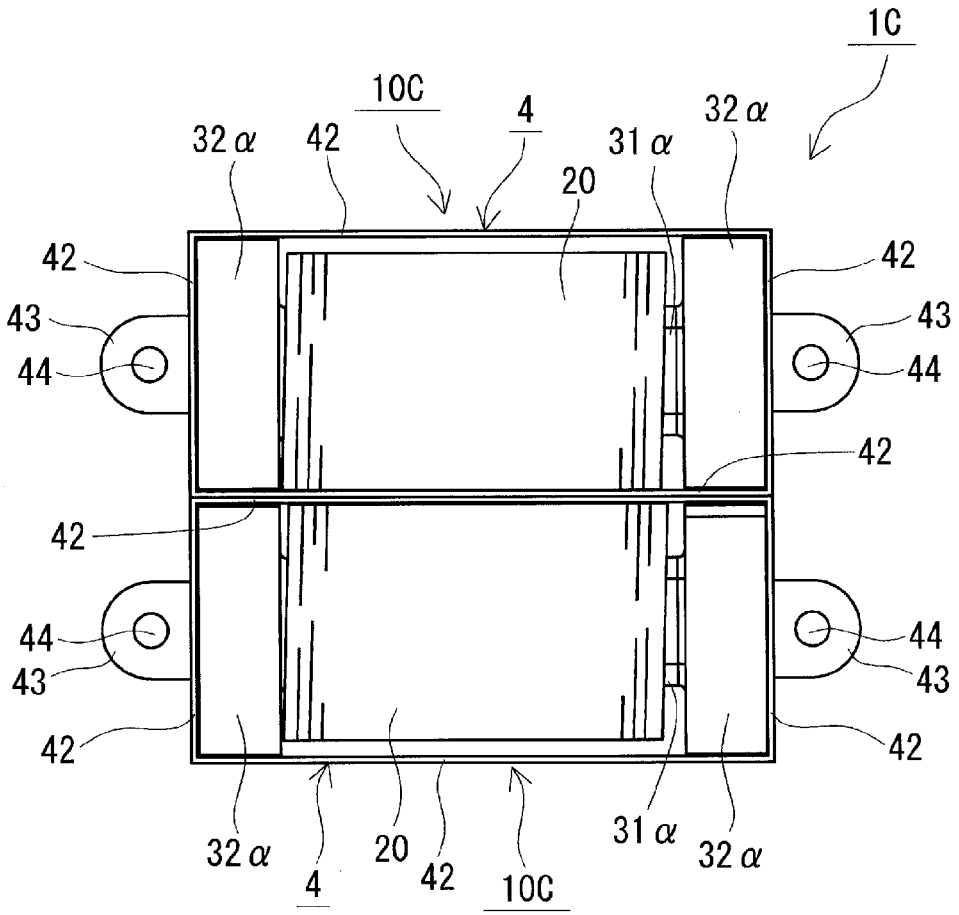
FIG. 4 is a top view schematically showing a reactor according to Embodiment 3.

A reactor 1C according to Embodiment 3 will be described with reference to FIG. 4. The reactor 1C differs from the reactor 1A according to Embodiment 1 in that divided reactors 10C each include a case 4 in which an assembly 11 that has one coil unit 20 and one core unit 30α is housed, and attachment portions 43 (holding member) are formed in the case 4 instead of the outer core portions 32α.

Divided Reactors

Case

A case 4 houses, inside thereof, an assembly 11 that has one coil unit 20 and one core unit 30α. As result of the assembly 11 being housed in the case 4, the assembly 11 can be protected from an external environment (dust, corrosion, etc.) and can be mechanically protected, and heat can be dissipated from the assembly 11. The case 4 includes a bottom plate portion (not shown) on which the assembly 11 is mounted and side wall portions 42 that at least partially surround the assembly 11.

The bottom plate portion has a rectangular flat plate-like shape, and a lower surface thereof is to be attached to the object (not shown) such as a cooling base. The side wall portions 42 extend upward from the entire peripheral edge of the bottom plate portion and form a substantially rectangular frame-like shape. The bottom plate portion and the side wall portions 42 are integrally molded. Of these side wall portions 42, side wall portions 42 that are disposed between adjacent assemblies 11 and oppose each other function as a gap between the adjacent assemblies 11 (outer core portions 32α). Here, the side wall portions 42 that are disposed between the adjacent assemblies 11 and oppose each other are in direct contact with each other.

A case 4 and a corresponding assembly 11 can be fixed to each other using the resin contained in the constituent material of the core unit 30α, for example. The fixation of the assembly 11 to the inside of the case 4 can be performed by using the case 4 as the mold in the production method of the divided reactor according to Embodiment 1.

The material of the case 4 may be a non-magnetic metal or a nonmetal material. Examples of the non-magnetic metal include aluminum and an alloy thereof, magnesium and an alloy thereof, copper and an alloy thereof, silver and an alloy thereof, iron, and austenitic stainless steel. These non-magnetic metals have relatively high thermal conductivity, and therefore, the entire case 4 can be used as a heat dissipation path. Thus, heat generated in the assembly 11 can be efficiently dissipated to the object (e.g., a cooling base), and the heat dissipation properties of the reactor 1C can be improved. Examples of the nonmetal material include resins such as polybutylene terephthalate (PBT) resins, urethane resins, polyphenylene sulfide (PPS) resins, and acrylonitrile-butadiene-styrene (ABS) resins. These nonmetal materials generally have excellent electrical insulation properties, and therefore, insulation between the coil unit 20 and the case 4 can be improved. These nonmetal materials are more lightweight than the aforementioned metal materials, and therefore enable a weight reduction of the divided reactors 10C. If a configuration in which a filler composed of a ceramic is mixed in the above-described resin is adopted, the heat dissipation properties can be improved. In a case where the case 4 is formed using a resin, injection molding can be suitably used.

Holding Member

Attachment Portions

The attachment portions 43 are integrally formed with the side wall portions 42 of the case 4. The formation of the attachment portions 43 can be performed by integrally casting the attachment portions 43 with the other portions of the case 4 through die-casting, for example. The core unit 30α is fixed to the object by attaching the case 4 to the object. Each attachment portion 43 is provided locally protruding from an outer peripheral surface of the corresponding side wall portion 42 of the case 4 like a flange. The portions where the attachment portions 43 are formed are set at the center of lower portions of the outer peripheral surfaces of the respective side wall portions 42 that are located on the axis of the coil unit 20. An insertion hole 44 through which a fastening member (not shown) can be inserted is formed in each of the attachment portions 43.

Effects

With the reactor 1C according to Embodiment 3, since the cases 4 are provided with the attachment portions 43, even in the case of the reactor 1C including the cases 4, an adjustment to a desired inductance can be easily made simply by adjusting the attachment positions of the cases 4.

Embodiment 4

Figure 5:
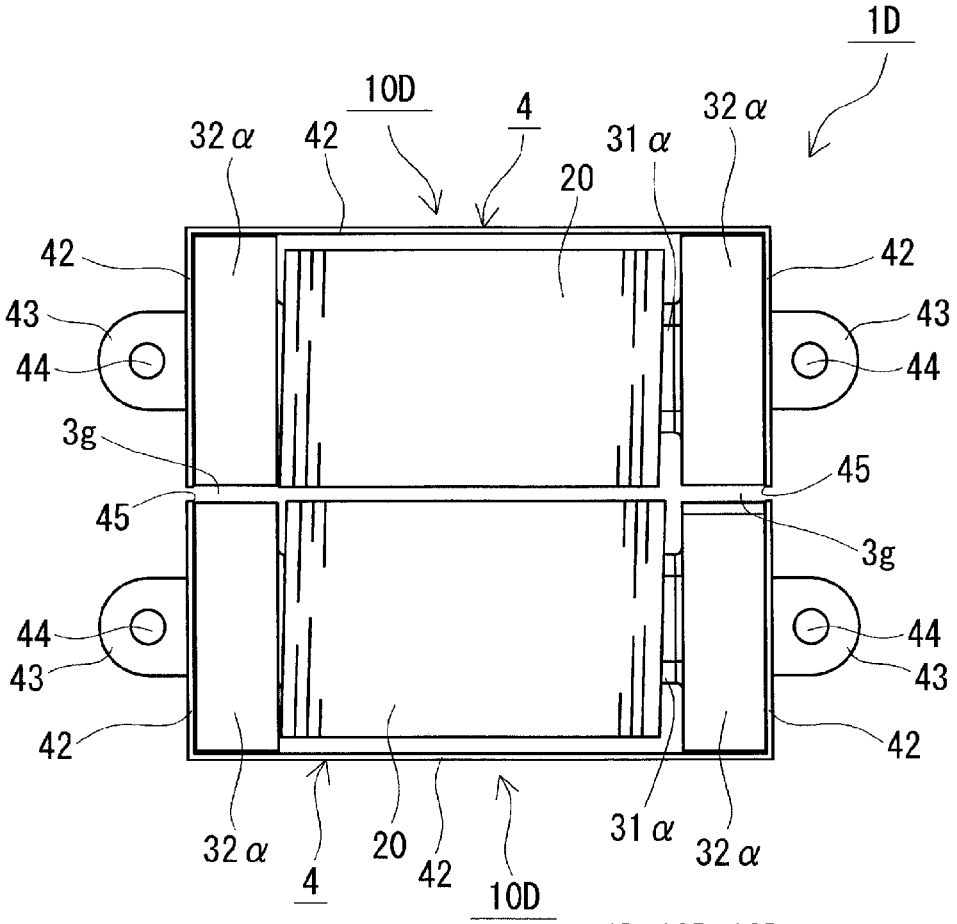
FIG. 5 is a top view schematically showing a reactor according to Embodiment 4.

A reactor 1D according to Embodiment 4 will be described with reference to FIG. 5. The reactor 1D includes the cases 4 and in this regard is the same as the reactor 1C according to Embodiment 3, but differs from the reactor 1C according to Embodiment 3 in that an opening 45 is formed where a side of the side wall portions 42 of each case 4, the side opposing an adjacent divided reactor 10D, is open.

The side wall portions 42 form a square bracket shape, and cover outer end surfaces of both outer core portions 32α and a side surface of the assembly 11 on the opposite side to the aforementioned opposing side. Air gaps 3*g* can be formed between the outer core portions 32α of the adjacent divided reactors 10D, as shown in FIG. 5. Alternatively, gap members made of a different material than that of the cases 4 can be disposed therebetween, or the outer core portions 32α can be brought into direct contact with each other with no gap 3*g* provided therebetween. Note that, during the production of the divided reactors 10D, an inner wall of a mold is placed at the opening 45 of the case 4 so as to prevent the constituent material of the core unit 30α from leaking from the case 4.

Effects

With the reactor 1D according to Embodiment 4, the gap can be easily adjusted simply by adjusting the spacing between two divided reactors 10D. Moreover, compared with the reactor 1C according to Embodiment 3, the opening 45 is formed in each case 4, and the weight of the case 4 and the amount of the constituent material of the case 4 can be reduced accordingly.

Embodiment 5

As a reactor according to Embodiment 5, which is not shown, a configuration can be adopted in which, in the case where divided reactors include respective cases 4 (see FIG. 4), engagement portions are provided that are formed in opposing surfaces of the cases 4 of the adjacent divided reactors and engage with each other. The engagement portions can have the same configuration as those of Embodiment 2 above, for example. The portions where the engagement portions are formed can be appropriately selected. For example, if the opening 45 is formed on the opposing side of each case 4 as in the cases according to Embodiment 4 (see FIG. 5), the engagement portions may be formed in opposing end surfaces of the side wall portions of the cases that form the openings.

Embodiment 6

Figure 6:
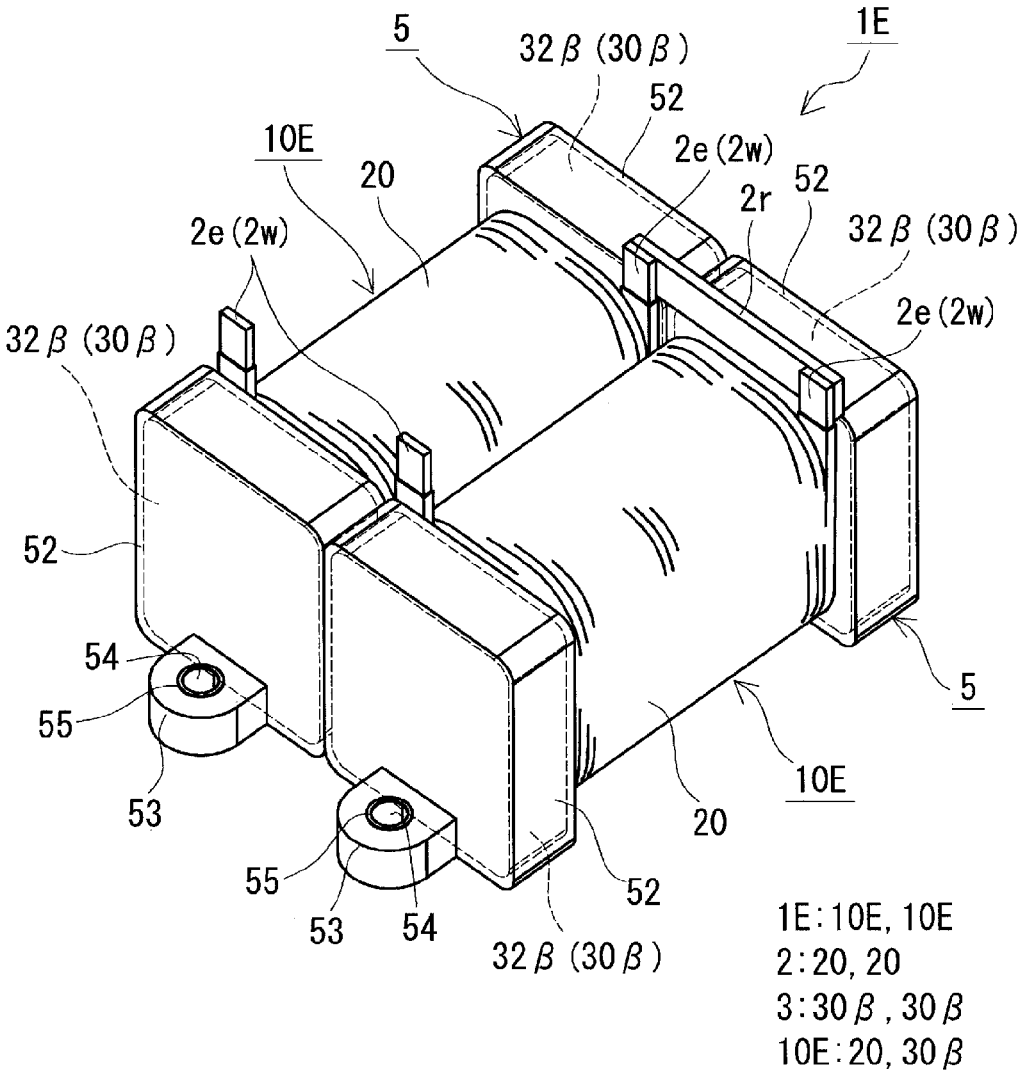
FIG. 6 is an overall perspective view schematically showing a reactor according to Embodiment 6.
Figure 7:
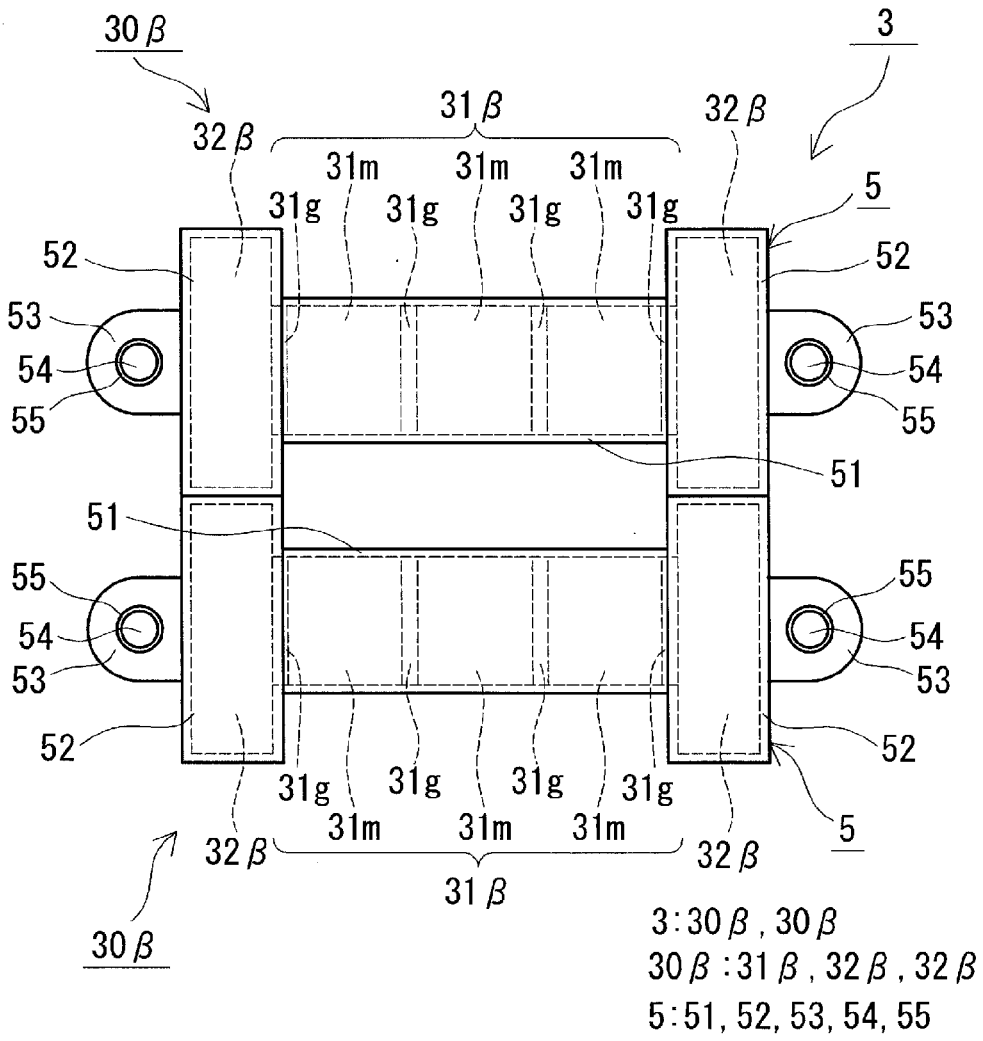
FIG. 7 is a top view showing a coated core unit of the reactor according to Embodiment 6.

A reactor 1E according to Embodiment 6 will be described with reference to FIGS. 6 and 7. The reactor 1E differs from the reactor 1A according to Embodiment 1 in that the reactor 1E includes a coated core unit 30β that has a plurality of core pieces into which a divided reactor 10E is divided and a resin coated portion 5 with which the core pieces are coated, and attachment portions 53 (holding member) are formed in the resin coated portion 5 instead of outer core pieces 32β.

Coated Core Unit

A coated core unit 30β includes one inner core piece 31β (inner core portion), a pair of outer core pieces 32β (outer core portions), and a resin coated portion 5 with which the core pieces 31β and 32β are coated.

The inner core piece 31β is constituted by a plurality of column-shaped divided core pieces 31*m*, gaps 31*g* provided between the divided core pieces 31*m*, and gaps 31*g* each provided between a corresponding one of the divided core pieces 31*m* and a corresponding one of the pair of outer core pieces 32β. The outer core pieces 32β are independent of the inner core piece 31β. The divided core pieces 31*m* and the outer core pieces 32β have rectangular parallelepiped shapes with rounded corners. The divided core pieces 31*m* and the outer core pieces 32β are each composed of a powder compact that is obtained by compression molding the above-described soft magnetic powder or a coated powder that further has an insulating coating.

The gaps 31*g* between the core pieces may be formed by gap members, which have been described in Embodiment 1, or may be formed by the resin coated portion 5, which will be described later. Here, the gaps 31*g* between the core pieces are formed by gap members made of alumina or the like.

Resin Coated Portion

The resin coated portion 5 has various functions, such as coating the inner core piece 31β and the outer core pieces 32β, forming the inner core piece 31β (joining the plurality of divided core pieces 31*m* to each other), joining the inner core piece 31β to the outer core pieces 32β, forming the gaps 31*g* between the divided core pieces 31*m* and between the divided core pieces 31*m* and the respective outer core pieces 32β, and integrating the coated core unit 30β and the coil unit 20.

The resin coated portion 5 has an inner coated portion 51 with which the inner core piece 31β is coated and outer coated portions 52 with which the outer core pieces 32β are respectively coated. The inner coated portion 51 and the outer coated portions 52 are integrally formed. The inner coated portion 51 covers the entire region of the inner core piece 31β excluding both ends of the inner core piece 31β in the axial direction thereof, and is in contact with both the inner peripheral surface of the coil unit 20 and the outer peripheral surface of the inner core piece 31β. The outer coated portions 52 each cover the entire region of a corresponding one of the outer core pieces 32β excluding a portion of that outer core piece 32β that opposes the inner core piece 31β, and the outer coated portions 52 are in contact with both end surfaces of the coil unit 20. Due to the above-described contact, the coil unit 20 as well as the core pieces 31β and 32β are integrally formed. Those portions of the outer coated portions 52 that are located between adjacent outer core pieces 32β function as a gap together. Here, the portions of the outer coated portions 52 between the adjacent outer core pieces 32β are in direct contact with each other. That is to say, two outer coated portions 52 are present between adjacent outer core pieces 32β, and therefore, an interface is formed between the two outer coated portions 52. Note that the outer peripheral surface of the coil unit 20 is not coated with the resin coated portion 5 and is thus exposed; however, this outer peripheral surface may be coated with the resin coated portion 5. That is to say, the entire region of the coil unit 20 may be coated with the resin coated portion 5.

Examples of the material of the resin coated portion 5 include a thermoplastic resin, a thermosetting resin, and the like. Examples of the thermoplastic resin include PPS resins, polytetrafluoroethylene (PTFE) resins, liquid crystal polymers (LCPs), polyamide (PA) resins such as nylon 6, nylon 66, nylon 10T, nylon 9T, and nylon 6T, PBT resins, ABS resins, and the like. Examples of the thermosetting resin include unsaturated polyester resins, epoxy resins, urethane resins, silicone resins, and the like.

The resin coated portion 5 can be easily formed by using an appropriate resin molding method such as injection molding or cast molding. Specifically, the resin coated portion 5 can be formed in the following manner: the coil unit 20 and the core pieces 31B and 32B are combined and placed in a predetermined mold, and the constituent material of the resin coated portion 5 is filled into and cured in the mold.

Holding Member

Attachment Portions

The attachment portions 53 are integrally formed with the resin coated portion 5 using the constituent material of the resin coated portion 5. The coated core unit 30β is fixed to the object by attaching the attachment portions 53 to the object. The attachment portions 53 are provided protruding from the outer end surfaces of the respective outer coated portions 52, in the axial direction of the coil units 20, like flanges. The portions where the attachment portions 53 are formed are set at the center of lower portions of the respective outer coated portions 52. As described above, if the attachment portions 53 face the object, creep deformation caused by a fastening member is likely to be suppressed, and therefore, the attachment portions 53 need not be provided with a collar. However, creep deformation is even more likely to be suppressed when collars 55 are embedded as in the present example. An insertion hole 54 for a fastening member is formed in each collar 55.

Others

In the case where the gaps 31*g* are formed by a part of the resin coated portion 5, it is preferable that the coated core unit 30β has connecting members (not shown) that are made of an insulating material and disposed between the coil unit 20 and the individual core pieces 31*m* and 32β. The same material as that of the resin coated portion 5 can be used as the material of the connecting members. End surface connecting members disposed between the coil unit 20 and the respective outer core pieces 32β as well as inner connecting members disposed between the coil unit 20 and the respective divided core pieces 31*m* may be provided as the connecting members.

The end surface connecting members may be formed of members having rectangular frame-like shapes that conform to the respective end surfaces of the coil unit 20. Each of the end surface connecting members has a recess into which the corresponding outer core piece 32β is fitted, and a spacing keeping portion that has a protruding shape and keeps a predetermined spacing between the outer core piece 32β and a corresponding one of the divided core pieces 31*m*. The recess makes it easy to cover the entire region of the outer core piece 32β excluding a portion thereof that opposes the inner core piece 31β. The spacing keeping portion maintains the spacing between the outer core piece 32β and the divided core piece 31*m*, and as a result of a part of the resin coated portion 5 being filled therebetween, the gap 31*g* constituted by the resin coated portion 5 can be formed between the outer core piece 32β and divided core piece 31*m*.

The inner connecting members may be constituted by a plurality of divided pieces, for example. The divided pieces are arranged so as to straddle spaces between the divided core pieces 31*m* that are lined up. The divided pieces may be square-bracket-shaped or U-shaped. The divided pieces each have, on their inner surfaces, a spacing keeping portion that has a protruding shape and that keeps a predetermined spacing between the divided core pieces 31*m*. The spacing keeping portions maintain the spacing between the divided core pieces 31*m*, and as a result of a part of the resin coated portion 5 being filled therebetween, the gaps 31*g* constituted by the resin coated portion 5 can be formed between the divided core pieces 31*m*.

Effects

With the reactor 1E according to Embodiment 6, since the resin coated portion 5 is provided with the attachment portions 53, even in the case of the reactor 1E including the resin coated portion 5, an adjustment to a desired inductance can be easily made simply by adjusting the attachment positions of the attachment portions 53.

Embodiment 7

A reactor according to Embodiment 7, which is not shown, differs from the reactor 1A according to Embodiment 1 in terms of the configuration of the holding member. Specifically, the holding member is constituted by a resin collectively-covering portion with which at least the outer core portions 32α of the adjacent divided reactors 10A (FIG. 1) are collectively coated. At this time, in a case where the adjacent outer core portions 32α are coated with the resin collectively-covering portion in a state in which the opposing surfaces of the outer core portions 32α are in direct contact with each other, the resin collectively-covering portion is not disposed between the outer core portions 32α. On the other hand, in a case where the adjacent outer core portions 32α are coated with the resin collectively-covering portion in a state in which the opposing surfaces of the outer core portions 32α are not in direct contact with each other and the gap 3*g* (FIGS. 1 and 2) is provided therebetween, the single resin collectively-covering portion that covers the adjacent outer core portions 32α is partially disposed between those opposing surfaces. Therefore, an interface between resin coated portions like that of the reactor 1E (FIGS. 6 and 7) according to Embodiment 6 above is not formed between the adjacent outer core portions 32α. That is to say, a portion between the outer core portions 32α and portions covering the outer peripheral surfaces of the outer core portions 32α, of the resin collectively-covering portion, are successively formed.

The same resin as that of the resin coated portion 5 (see FIG. 6) of Embodiment 6 above can be used as the material of the resin collectively-covering portion. The resin collectively-covering portion can be formed in the following manner: arrangement is performed so that the spacing between outer core portions 32α that are adjacent to each other within a mold is a specified spacing, and the constituent material of the resin collectively-covering portion is filled into and cured in the mold. Thus, a reactor in which a specified spacing is kept between the outer core portions by the coated collectively-covering portion can be obtained.

In addition to covering the adjacent outer core portions 32α, the resin collectively-covering portion may successively cover the inner core portions 31α connected to the respective outer core portions 32α, and furthermore, may also successively cover the coil units 20 disposed around the outer peripheries of the respective inner core portions 31α. That is to say, the resin collectively-covering portion may collectively (successively) cover the adjacent core units 30α, or may collectively (successively) cover the adjacent coil units 20 and the adjacent core units 30α. The resin collectively-covering portion may also have the attachment portions 53, like those of Embodiment 6, that are each constituted by a part of the resin coated portion 5.

Embodiment 8

A reactor according to Embodiment 8, which is not shown, differs from the reactor according to Embodiment 1 in terms of the configuration of the holding member. Specifically, the holding member is constituted by a support portion that presses down the upper surface of each divided reactor 10A (outer core portion 32α) toward the lower surface side. The pressing-down by the support portion may be performed by a shared support portion collectively pressing down the adjacent divided reactors 10A, or may be performed by individual support portions that are independent from each other pressing down the respective divided reactors 10A. In the case where a shared support portion is used, for example, the number of support portions may be two, each support portion being provided straddling the adjacent outer core portions 32α so as to come into contact with the upper surfaces of both of the outer core portions 32α, and both ends thereof being fixed to the object. In the case where individual support portions are used, for example, the number of support portions may be four, each support portion pressing down a corresponding one of the two outer core portions 32α of each of the divided reactors 10A. In this case, one end of each support portion may be disposed such that it is in contact with the upper surface of the corresponding outer core portion 32α, with the other end being fixed to the object. A flat plate that is appropriately bent in accordance with the difference in height between the upper surface of the outer core portion and the object can be used as each support portion. Moreover, in the case where a shared support portion is used, a flat plate spring in which a portion that comes into contact with the upper surface of the outer core portion 32α is bent downward can be used as each support portion. The same metal as that of the cases 4 (see FIG. 4) of Embodiment 3 above may be used as the material of the support portion.

Uses

The above-described reactors can be suitably used for a constituent component of various converters, such as in-vehicle converters (typically, DC-DC converters) installed in vehicles such as hybrid automobiles, plug-in hybrid automobiles, electric automobiles, and fuel-cell electric automobiles and converters for air conditioners, and power conversion devices.

The present disclosure is not limited to the foregoing examples, but rather is defined by the claims, and all changes that come within the meaning and range of equivalency of the claims are intended to be embraced therein.

The invention claimed is:

1. A reactor comprising:

a coil;

an annular magnetic core that forms a closed magnetic circuit when the coil is excited;

a plurality of divided reactors that constitute the reactor by being arranged in parallel; and a holding member that holds the plurality of divided reactors in a state in which the divided reactors are arranged in parallel at a predetermined spacing, wherein each of the divided reactors includes:

a coil unit that is formed of a wound wire and constitutes a part of the coil; and a core unit that passes through the coil unit from one end of the coil unit to the other end and constitutes a part of the magnetic core, the core unit has:

an inner core portion inserted through the coil unit, and outer core portions that protrude from both ends of the coil unit and extend in a direction that intersects the inner core portion, and the holding member includes:

attachment portions that are provided on an outer surface of opposing ends of the outer core portions of each of the divided reactors and fix the core units to an object to which the reactor is attached such that the core units are arranged in parallel.

2. The reactor according to claim 1, further comprising:

a gap that is provided between the outer core portions of adjacent ones of the divided reactors.

3. The reactor according to claim 1, wherein each of the attachment portions includes an insertion hole for accommodating a fastening member.

4. The reactor according to claim 1, wherein each of the attachment portions is integrally formed to the outer core portions.

5. The reactor according to claim 1, wherein each of the attachment portions is provided perpendicular to an outer surface of ends to the outer core portion opposing the inner core portions.

* * * * *